US006372396B1

(12) United States Patent
Yu et al.

(10) Patent No.: US 6,372,396 B1
(45) Date of Patent: Apr. 16, 2002

(54) ELECTROSTATOGRAPHIC IMAGING MEMBER PROCESS

(75) Inventors: Robert C. U. Yu; Satchidanand Mishra, both of Webster; Kathleen M. Carmichael, Williamson; Richard L. Post, Penfield; Bing R. Hsieh, Webster; Anthony M. Horgan, Pittsford; Edward F. Grabowski, Webster; Donald C. Von Hoene, Fairport; Huoy-Jen Yuh, Pittsford; Michael S. Roetker, Webster, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/692,924

(22) Filed: Oct. 20, 2000

(51) Int. Cl.[7] ..... G03G 15/00
(52) U.S. Cl. ..... 430/56; 430/58.05; 430/69; 430/127; 430/930
(58) Field of Search ..... 430/56, 69, 930, 430/58.05, 127

(56) References Cited

U.S. PATENT DOCUMENTS

| | | | | |
|---|---|---|---|---|
| 4,647,521 A | | 3/1987 | Oguchi et al. | 430/58 |
| 4,654,284 A | | 3/1987 | Yu et al. | 430/59 |
| 4,664,995 A | | 5/1987 | Horgan et al. | 430/59 |
| 4,869,982 A | | 9/1989 | Murphy | 430/58 |
| 5,021,309 A | | 6/1991 | Yu | 430/58 |
| 5,096,792 A | | 3/1992 | Simpson et al. | 430/58 |
| 5,096,795 A | | 3/1992 | Yu et al. | 430/59 |
| 5,215,839 A | | 6/1993 | Yu | 430/58 |
| 5,595,845 A | * | 1/1997 | Maeda et al. | 430/59.2 |
| 5,725,983 A | | 3/1998 | Yu | 430/58 |
| 6,258,499 B1 | * | 7/2001 | Itami | 430/56 |

* cited by examiner

*Primary Examiner*—Mark Chapman
(74) *Attorney, Agent, or Firm*—Robert Thompson

(57) ABSTRACT

A process including providing at least a flexible substrate layer having a first major surface on one side and a second major surface on a second side opposite the first major surface, the first major surface being an exposed surface, applying a coating of an anticurl backing layer dispersion on the first major surface of the substrate layer, the dispersion comprising a volatile carrier liquid, a film forming polymer dissolved in the volatile carrier liquid, solid organic particles dispersed in the volatile carrier liquid, and an organic additive dissolved in the volatile carrier liquid, the organic additive represented by the structural formula:

wherein m is a number from 1 to 99, n is a number from 1 to 99, p is an integer between 1 and 10, f is an integer between 1 and 8, and I is an integer between 10 and 500, and drying the coating to remove the volatile carrier and form a dried anticurl backing layer. An electrostatographic imaging member containing this anticurl backing layer is also described.

18 Claims, 3 Drawing Sheets

ELECTROSTATOGRAPHIC IMAGING MEMBER PROCESS

CROSS REFERENCE TO COPENDING APPLICATIONS

Attention is directed to commonly assigned copendinq application: (D/A0890) filed concurrently herewith, entitled "ELECTROSTATOGRAPHIC IMAGING MEMBER" which discloses a process including providing at least a flexible substrate layer having a first major surface on one side and a second major surface on a second side opposite the first major surface, the first major surface being an exposed surface, applying a coating of an anti-curl backing layer dispersion on the first major surface of the substrate layer, the dispersion comprising a volatile carrier liquid, a film forming polymer dissolved in the volatile carrier liquid, a film forming polymer dissolved in the volatile carrier liquid, solid organic particles dispersed in the volatile carrier liquid, and an organic additive, such as a fluorinated acrylate copolymer, dissolved in the volatile carrier liquid; and drying the coating to remove the volatile carrier and form a dried anti-curl backing layer. An electrostatographic imaging member containing the resulting anti-curl backing layer is also described.

The disclosures of the above mentioned copending application is incorporated herein by reference in its entirety. The appropriate components and processes of these patents may be selected for the articles and processes of the present invention in embodiments thereof.

BACKGROUND INFORMATION

The present invention relates to an imaging member fabrication process and, more specifically, to a process for fabricating anticurl backing layers for flexible electrostatographic imaging members.

Electrostatographic flexible imaging members are well known in the art. Typical electrostatographic flexible imaging members include, for example, photosensitive members (photoreceptors) commonly utilized in electrophotographic (xerographic) processes and electroreceptors such as ionographic imaging members for electrographic imaging systems. The flexible electrostatographic imaging members may be seamless or seamed belts. Typical electrophotographic imaging member belts comprise a charge transport layer and a charge generating layer on one side of a supporting substrate layer and an anticurl backing layer coated on the opposite side of the substrate layer. A typical electrographic imaging member belt comprises a dielectric imaging layer on one side of a supporting substrate and an anticurl backing layer on the opposite side of the substrate.

Electrophotographic flexible imaging members may comprise a photoconductive layer comprising a single layer or composite layers. One type of composite photoconductive layer used in electrophotography is illustrated in U.S. Pat. No. 4,265,990 which describes a photosensitive member having at least two electrically operative layers. One layer comprises a photoconductive layer which is capable of photogenerating holes and injecting the photogenerated holes into a contiguous charge transport layer. Generally, where the two electrically operative layers are supported on a conductive layer with the photoconductive layer sandwiched between the contiguous charge transport layer and the conductive layer, the outer surface of the charge transport layer is normally charged with a uniform charge of a negative polarity and the supporting electrode is utilized as an anode. Obviously, the supporting electrode may still function as an anode when the charge transport layer is sandwiched between the supporting electrode and the photoconductive layer. The charge transport layer in this latter embodiment must be capable of supporting the injection of photogenerated electrons from the photoconductive layer and transporting the electrons through the charge transport layer. Photosensitive members having at least two electrically operative layers, as disclosed above, provide excellent electrostatic latent images when charged with a uniform negative electrostatic charge, exposed to a light image and thereafter developed with finely divided electroscopic marking particles. The resulting toner image is usually transferred to a suitable receiving member such as paper.

As more advanced, higher speed electrophotographic copiers, duplicators and printers were developed, degradation of image quality was encountered during extended cycling. Moreover, complex, highly sophisticated duplicating and printing systems operating at very high speeds have placed stringent requirements including narrow operating limits on photoreceptors. For electrophotographic imaging members having a belt configuration, the numerous layers found in modern photoconductive imaging members must be highly flexible, adhere well to adjacent layers, and exhibit predictable electrical characteristics within narrow operating limits to provide excellent toner images over many thousands of cycles. One type of multilayered photoreceptor that has been employed as a belt in electrophotographic imaging systems comprises a substrate, a conductive layer, a blocking layer, an adhesive layer, a charge generating layer, a charge transport layer, and a conductive ground strip layer adjacent to one edge of the imaging layers. This photoreceptor belt may also comprise additional layers such as an anticurl backing layer to achieve the desired belt flatness. An optional overcoating layer over the charge transport layer may be used for wear and chemical protection.

In a machine service environment, a flexible imaging member belt, mounted on a belt supporting module, is generally exposed to repetitive electrophotographic image cycling which subjects the exposed anticurl backing layer to abrasion due to mechanical fatigue and interaction with the belt drives and other support rollers as well as sliding contact with backer bars. This repetitive cycling leads to a gradual deterioration in the physical/mechanical integrity of the exposed anticurl backing layer. When the anticurl layer is worn the thickness thereof is reduced and the anticurl backing layer experiences a loss of ability to counteract the tendency of imaging members to curl upwardly thereby leading, to belt curl. Moreover, uneven wear of the anticurl backing layer has been found to cause early development of belt ripples which are ultimately manifested as copy printout defects. Thus, the anticurl backing layer wear resulting from mechanical contact interaction during dynamic imaging operations is a serious problem that shortens the service life of the belt and adversely affects image quality.

When a production web stock of several thousand feet of coated multilayered photoreceptor is rolled up, the charge transport layer and the anticurl layer are in intimate contact. The high surface contact friction of the charge transport layer against the anticurl layer causes dimples and creases to develop in the internal layers of the photoreceptor. Since these physically induced defects manifest themselves as print defects in xerographic copies, the unacceptable segments of this photoreceptor web stock are discarded thereby decreasing production yield. Although attempts have been made to overcome these problems, the solution of one problem often leads to the generation of additional problems.

Flexible photoreceptor belts are fabricated from sheets cut from an electrophotographic imaging member web stock. The cut sheets are generally rectangular in shape. All edges may be of the same length or one pair of parallel edges may be longer than the other pair of parallel edges. The sheet is formed into a belt by joining the overlapping opposite marginal end regions of the sheet. A seam is typically produced in the overlapping opposite marginal end regions at the point of joining. Joining may be effected by any suitable means such as welding (including ultrasonic processes), gluing, taping, pressure/heat fusing, and the like. However, ultrasonic seam welding is generally the preferred method of joining because it is rapid, clean (no application of solvents) and produces a thin and narrow seam. The ultrasonic seam welding process involves a mechanical pounding action of a welding horn which generate a sufficient amount of heat energy at the contiguous overlapping marginal end regions of the imaging member sheet to maximize melting of one or more layers therein. A typical ultrasonic welding process is carried out by holding down the overlapping ends of the flexible imaging member sheet with vacuum onto a flat anvil and guiding the flat end of the ultrasonic vibrating horn transversely across the width of the sheet and directly over the overlapped junction to form a welded seam having two adjacent seam splashings consisting of the molten mass of the imaging member layers ejected to the either side of the welded overlapped seam. These seam splashings of the ejected molten mass comprise about 40 percent by weight of anticurl layer material. The splashings can include hard crystalline materials and have a rough abrasive outer surface which abrades the photoreceptor cleaning blade during dynamic image cycling causing the blade to lose cleaning efficiency and shortens blade service life.

Alteration of material formulation in the anticurl backing layer of imaging member belt can enhance wear resistance and extend life, but this can also produce undesirable outcomes For example, incorporation of crystalline particles in the outermost exposed layers of the imaging member to improve wear resistance has been observed to cause excessive wear of the ultrasonic horn used to ultrasonically weld the seams of imaging belts. Thus, the resolution of one problem has led to the creation of another problem. In another prior art approach to resolve the imaging member coating layer wear problems, synthetic organic particles have been incorporated into the exposed anticurl backing layer of the imaging member to improve abrasion resistance. However, such incorporation has been observed to cause the formation of bubbles in the dried anticurl backing layer. These bubbles adversely affect the thickness uniformity of the layer which in turn affects critical physical characteristics such as, for example, alteration of intimate surface contact friction requirements between the anticurl backing layer and the drive-roller of the belt support module. This alteration of friction adversely impacts the driving capacity of drive-rollers thereby causing imaging belt slippage during dynamic belt operation. Moreover, the alteration has also been found to reduce the mechanical strength of anticurl backing layers and capability to resist fatigue induced anticurl backing layer cracking. The presence of bubbles in the anticurl backing layer can also negate and diminish the benefit of wear resistance enhancements, otherwise achievable through dispersion of organic particles in imaging members, by increasing wear rate. Also, due to the presence of bubbles, weakening of the layer and premature cracking of the imaging member can occur when fatigue tension/compression strain is repeatedly applied to the anticurl backing layer during machine cycling, particularly when cycling around small diameter support rollers. Further, when rear erase is employed to discharge the photoreceptor belt during electrophotographic imaging processes, the presence of bubbles causes a light scattering effect which leads to undesirable non-uniform discharge. Also, the presence of bubbles in the anticurl backing layer during seam welding processes cause the bubbles to expand and form splashings having open pits. During electrophotographic imaging and cleaning cycles, these open pits can function as sites that trap toner, debris, and dirt particles making attempts to clean the imaging member belt extremely difficult. It has also been found that, during imaging belt cycling, the trapped toner, debris, and dirt particles can be carried out by the cleaning blade from the pits to contaminate the vital imaging components such as lenses, HSD, HJD and, other subsystems, and can also lead to undesirable artifacts which form undesirable printout defects in the final image copies.

INFORMATION DISCLOSURE STATEMENT

U.S. Pat. No. 5,021,309 to R. Yu, issued Jun. 4, 1991—In an electrophotographic imaging device, material for an exposed anti-curl layer has organic fillers dispersed therein are disclosed The fillers provide coefficient of surface contact friction reduction, increased wear resistance, and improved adhesion of the anti-curl layer, without adversely affecting the optical and mechanical properties of the imaging member.

U.S. Pat. No. 5,096,795 to R. Yu, issued Mar. 17, 1992—An electrophotographic imaging device is disclosed in which material for exposed layers contain either organic or inorganic particles uniformly dispersed therein. The particles provide reduced coefficient of surface contact friction, increased wear resistance, durability against tensile cracking, and improved adhesion of the layers without adversely affecting the optical and electrical properties of the imaging member.

U.S. Pat. No. 5,725,983 to R. Yu, issued Mar. 10, 1998—An electrophotographic imaging member is disclosed comprising a supporting substrate having an electrically conductive layer, a hole blocking layer, an optional adhesive layer, a charge generating layer, a charge transport layer, an anticurl back coating, a ground strip layer and an optional overcoating layer, at least one of the charge transport layer, anticurl back coating, ground strip layer and overcoating layer comprising a blend of inorganic and organic particles homogeneously distributed in a weight ratio of between about 3:7 and about 7:3 in a film forming matrix, the inorganic particles and organic particles having a particle diameter less than about 4.5 micrometers. These electrophotographic imaging members may have a flexible belt form or rigid drum configuration. These imaging members may be utilized in an electrophotographic imaging process.

U.S. Pat. No. 4,647,521 to Y. Oguchi et al., issued Mar. 3, 1987—A photosensitive member or image holding member, for electrophotography is disclosed having a conductive substrate, a top layer for holding an electrostatic image and/or toner image wherein the top layer is formed by applying a coating fluid containing hydrophobic silicon and a binder resin.

U.S. Pat. No. 4,654,284 to R. Yu. et al., issued Mar. 31, 1987—An imaging member is disclosed comprising at least one flexible electrophotographic imaging layer, a flexible supporting substrate layer having an electrically conductive surface and an anticurl layer, the anticurl layer comprising a film forming binder, crystalline particles dispersed in the film forming binder and a reaction product of a bifunctional chemical coupling agent with both the film forming binder and the crystalline particles. This imaging member may be employed in an electrostatographic imaging process.

U.S. Pat. No. 4,664,995 to A. Horgan et al., issued May 12, 1987—An electrostatographic imaging member is disclosed comprising at least one imaging layer capable of retaining an electrostatic latent image, a supporting substrate layer having an electrically conductive surface, and an electrically conductive ground strip layer adjacent the electrostatographic imaging layer and in electrical contact with the electrically conductive layer, the electrically conductive ground strip layer comprising a film forming binder, conductive particles and crystalline particles dispersed in the film forming binder, and a reaction product of a bifunctional chemical coupling agent with both the film forming binder and the crystalline particles. This imaging member may be employed in an electrostatographic imaging process.

U.S. Pat. No. 4,869,982 to W. Murphy, issued Sept. 26, 1989—An electrophotographic photoreceptor is disclosed containing a toner release material in one or more electrically operative layers such as a charge transport layer. From about 0.5 to about 20 percent of a toner release agent selected from stearates, silicon oxides and fluorocarbons is incorporated into an imaging layer such as a charge transport layer.

U.S. Pat. No. 5,215,839 to R. Yu, issued Jun. 1, 1993—A layered electrophotographic imaging member is disclosed. The member is modified to reduce the effect of interference caused by the reflections from coherent light incident on a ground plane. Modification involves an interface layer between a blocking layer and a charge generation layer, the interface layer comprising a polymer having incorporated therein filler particles of a synthetic silica or mineral particles. The filler particles scatter the light to prevent reflections from the ground planes back to the light incident the surface.

U.S. Pat. No. 5,096,792 to Y. Simpson et al, issued Mar. 17,1992—A layered photosensitive imaging member is disclosed which is modified to reduce the effects of interference within the member caused by reflections from coherent light incident on a base ground plane. The modification involves a ground plane surface with a rough surface morphology by various selective deposition methods. Light reflected from the ground plane formed with the rough surface morphology is diffused through the bulk of the photosensitive layer breaking up the interference fringe patterns which are later manifested as a plywood pattern on output prints made from the exposed sensitive medium.

While the above mentioned electrophotographic imaging members may be suitable for their intended purposes, there continues to be a need for improved processes for fabricating imaging members, particularly for material modified multilayered electrophotographic imaging members having mechanically robust exposed layers in a flexible belt configuration.

SUMMARY OF THE INVENTION

It is therefore an object of the present invention to provide improved process for fabricating anticurl backing layers for layered electrostatographic imaging members which overcome the above noted disadvantages.

It is another object of the present invention to provide an improved process for fabricating anticurl backing layers that involve a modified anticurl layer coating composition.

It is also an object of the present invention to provide an improved process for fabricating anticurl backing layers that enhances optical clarity and superior lubrication characteristics of the anticurl backing layers.

It is yet another object of the present invention to provide an improved process for fabricating anticurl backing layers having the ability to suppress the development of belt ripples during dynamic imaging belt cycling.

It is still an object of the present invention to provide an improved process for fabricating anticurl backing layers for flexible layered electrostatographic imaging member belts involving the use of a reformulated anticurl backing layer coating composition that improves seam splashing surface lubrication.

It is a further object of the present invention to provide an improved process for fabricating anticurl backing layers that leads to improved flexible layered electrostatographic imaging belts having a seam splashing morphology that resists the early onset of fatigue bending induced seam cracking and delamination.

It is also another object of the present invention to provide an improved process for fabricating anticurl backing layers that are mechanically robust and provide clean machine belt cycling with minimum wear and generation of debris and dust.

It is another object of the present invention to provide an improved process for fabricating anticurl backing layers to produce an improved layered flexible electrophotographic imaging members web having reduced surface contact friction between the charge transport layer and the anticurl back coating in rolled up web stock.

It is still a further object of the present invention to provide an improved process for fabricating anticurl backing layers having organic particles dispersed in the which do not cause ultrasonic horn wear during the ultrasonic welding of seams to form belts.

It is yet another object of the present invention to provide an improved process for fabricating anticurl backing layers to form improved layered flexible electrophotographic imaging member belts that are free of belt wrinkles, puckering, and ripples that induce print copy output defects.

It is also an object of the present invention to provide an improved process for fabricating anticurl backing layers using a reformulated anticurl backing layer containing organic particles dispersion in a film forming polymer matrix which is free of bubble defects and which produces enhanced wear resistant anticurl backing layers in flexible electrostatographic imaging member belts.

These and other objects of the present invention are accomplished by a process comprising

- providing at least a flexible substrate layer having a first major surface on one side and a second major surface on a second side opposite the first major surface, the first major surface being an exposed surface,
- applying a coating of an anticurl backing layer dispersion on the first major surface of the substrate layer, the dispersion comprising
  - a volatile carrier liquid,
  - a film forming polymer dissolved in the volatile carrier liquid,
  - solid organic particles dispersed in the volatile carrier liquid, and
  - a dissolved organic additive represented by the structural formula:

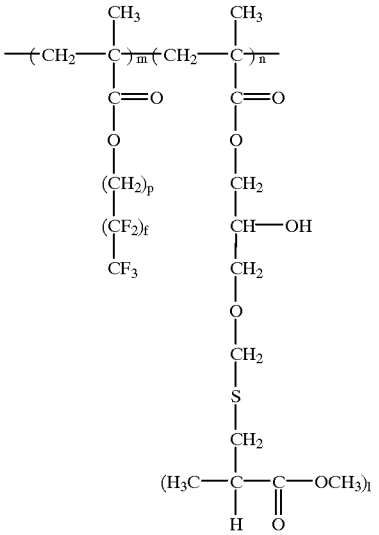

dissolved in the volatile carrier liquid, wherein m is a number from 1 to 99, n is a number from 1 to 99, p is an integer between 1 and 10, f is an integer between 1 and 8, and I is an integer between 10 and 500, and drying the coating to remove the volatile carrier and form a dried anticurl backing layer.

An electrostatic imaging member fabricated by the above-described process is also contemplated.

Although the discussions hereinafter will focus mainly on fabricating flexible electrophotographic imaging member belts (photoreceptor belts), they are equally applicable to fabricating electrographic imaging members (e.g., ionongraphic belts).

Flexible electrophotographic imaging member belts generally comprise a supporting substrate having an electrically conductive surface, an optional hole blocking layer, an optional adhesive layer, a charge generating layer, a charge transport layer, an anticurl backing layer, an optional ground strip layer and an optional overcoating layer. The exposed anticurl backing layer fabricated by the process of this invention comprises synthetic organic particles homogeneously dispersed in a film forming polymer matrix which overcomes the deficiencies of prior anticurl backing layers.

BRIEF DESCRIPTION OF THE DRAWINGS

A more complete understanding of the imaging device of the present invention purpose can be obtained by reference to the accompanying drawings wherein.

Figure 1:
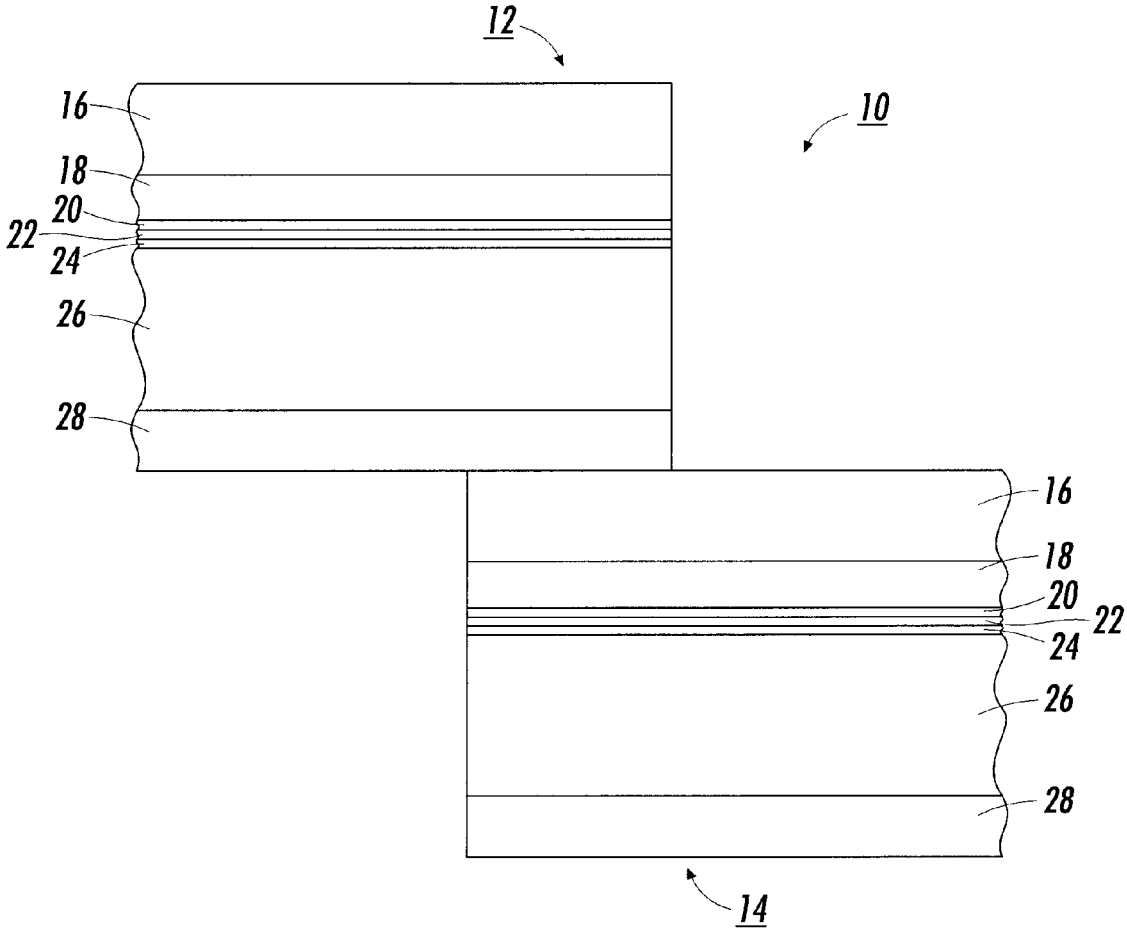
FIG. 1 illustrates a schematic partial cross-sectional view of a multiple layered flexible sheet of electrophotographic imaging material with opposite ends overlapped.

In the drawings and the following description, it is to be understood that like numeric designations refer to components of like function.

DETAILED DESCRIPTION OF THE DRAWINGS

Although specific terms are used in the following description for the sake of clarity, these terms are intended to refer only to the particular structure of the invention selected for illustration in the drawings, and are not intended to define or limit the scope of the invention.

Referring to FIG. 1, there is illustrated a flexible imaging member 10 in the form of a sheet having a first end marginal region 12 overlapping a second end marginal region 14 to form an overlap region ready for a seam forming operation. The flexible imaging member 10 can be utilized within an electrophotographic imaging member device and may be a member having a film substrate layer combined with one or more additional coating layers. At least one of the coating layers comprises a film forming binder.

The flexible imaging member 10 may comprise multiple layers. If the flexible imaging member 10 is to be a negatively charged photoreceptor device, the flexible imaging member 10 may comprise a charge generator layer sandwiched between a conductive surface and a charge transport layer. Alternatively, the flexible member 10 may comprise a charge transport layer sandwiched between a conductive surface and a charge generator layer.

The layers of the flexible imaging member 10 can comprise numerous suitable materials having suitable mechanical properties. Examples of typical layers are described in U.S. Pat. No. 4,786,570, U.S. Pat. No. 4,937,117 and U.S. Pat. No. 5,021,309, the entire disclosures thereof being incorporated herein by reference. The belt or flexible imaging member 10 shown in FIG. 1, including the two end marginal regions 12 and 14, comprises from top to bottom a charge transport layer 16, a generator layer 18, an interface layer 20, a blocking layer 22, a conductive ground plane layer 24, a supporting layer 26, and an anti-curl back coating layer 28. It should be understood that the thickness of the layers are conventional and that a wide range of thicknesses can be used for each of the layers.

Figure 2:
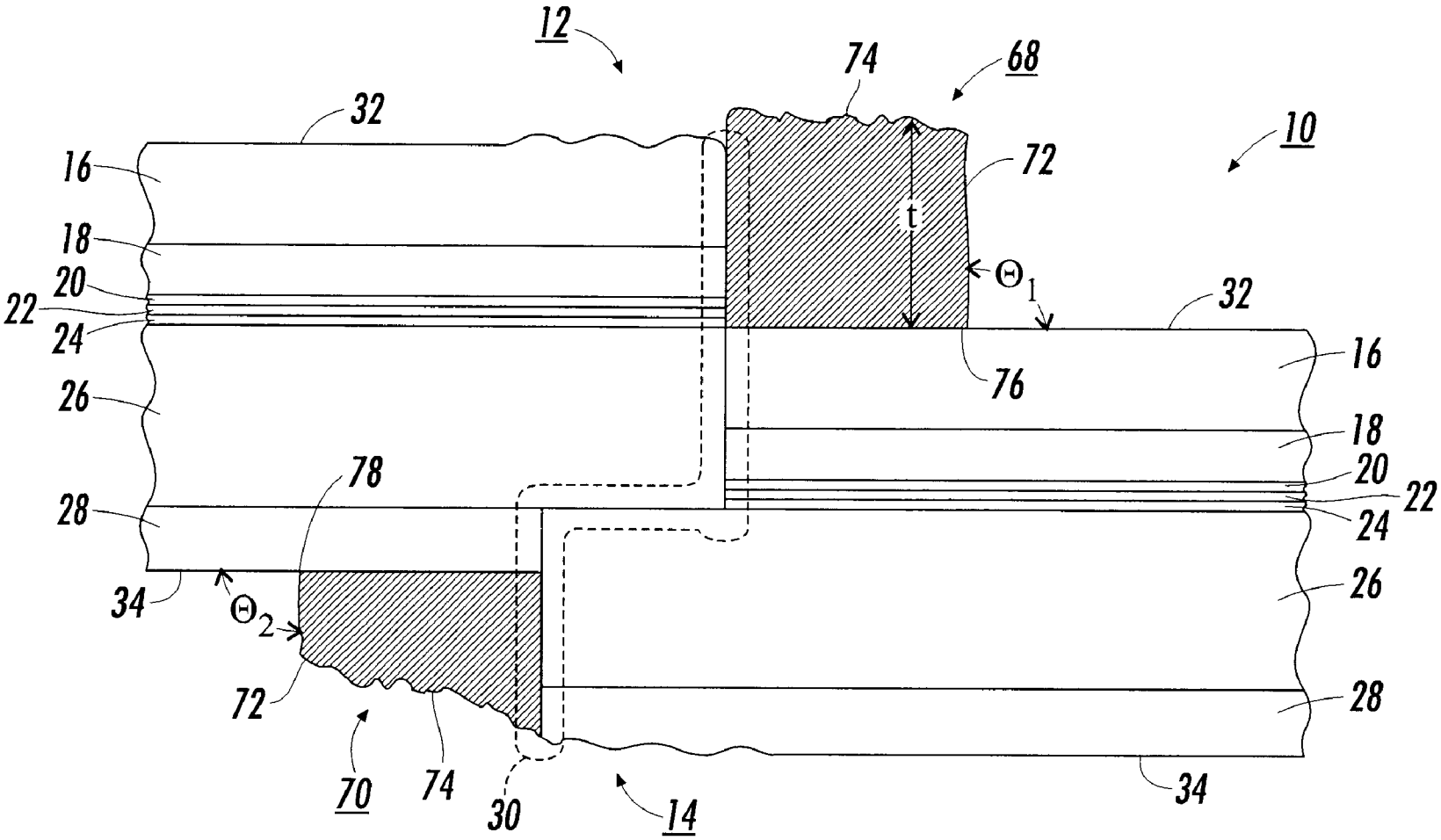
FIG. 2 shows a schematic partial cross-sectional view of a multiple layered seamed flexible electrophotographic imaging belt derived from the sheet illustrated in FIG. 1 after ultrasonic seam welding.

Although the end marginal regions 12 and 14 can be joined by any suitable means including ultrasonic welding, gluing, taping, stapling, and pressure and heat fusing to form a continuous imaging member seamed belt, sleeve, or cylinder, nevertheless, from the viewpoint of considerations such as ease of belt fabrication, short operation cycle time, and mechanical strength of the fabricated joint, the ultrasonic welding process is preferably used to join the end marginal regions 12 and 14 of imaging member sheet 10 into a seam 30 in the overlap region, as illustrated in FIG. 2 to form a seamed flexible imaging member belt 10. As illustrated in FIG. 2, the location of seam 30 is indicated by a dotted line. Seam 30 comprises two vertical portions joined by a horizontal portion. Thus, the midpoint of seam 30 may be represented by an imaginary centerline extending the length of seam 30 from one edge to the opposite edge of belt 10, the imaginary centerline (not shown) running along the middle of the horizontal portion which joins the two vertical portions illustrated in FIG. 2. In other words, a plan view (not shown) of the horizontal portion of seam 30 would show a strip much like a two lane highway in which the centerline would be represented by the white divider line separating the two lanes, the two lanes comprising end marginal regions 12 and 14. The flexible imaging member is thus transformed from a sheet of electrophotographic imaging member material as illustrated in FIG. 1 into a continuous electrophotographic imaging member belt 10 as illustrated in FIG. 2. The flexible imaging member belt 10 has a first major exterior surface or side 32 and a second major exterior surface or side 34 on the opposite side. The seam 30 joins the flexible imaging member 10 so that the bottom surface 34 (generally including at least one layer immediately above) at and/or near the first end marginal region 12 is integral with the top surface 32 (generally including at east one layer immediately below) at and/or near the second end marginal region 14.

When an ultrasonic welding process is employed to transform the sheet of flexible imaging member material into an imaging member belt, the seam of the belt is created by the high frequency mechanical pounding action of a welding horn over the overlapped opposite end regions of the imaging member sheet to cause material fusion. In the ultrasonic seam welding process, ultrasonic energy generated by the welding horn action, in the form of heat is applied to the overlap region to melt suitable layers such as the charge transport layer 16, generator layer 18, interface layer 20, blocking layer 22, part of the support layer 26 and/or anticurl backing layer 28. The anticurl backing layer formed by the process of the present invention comprises synthetic organic particles dispersed in a film forming polymer matrix. Direct fusing of the support layer achieves optimum seam strength.

Figure 3:
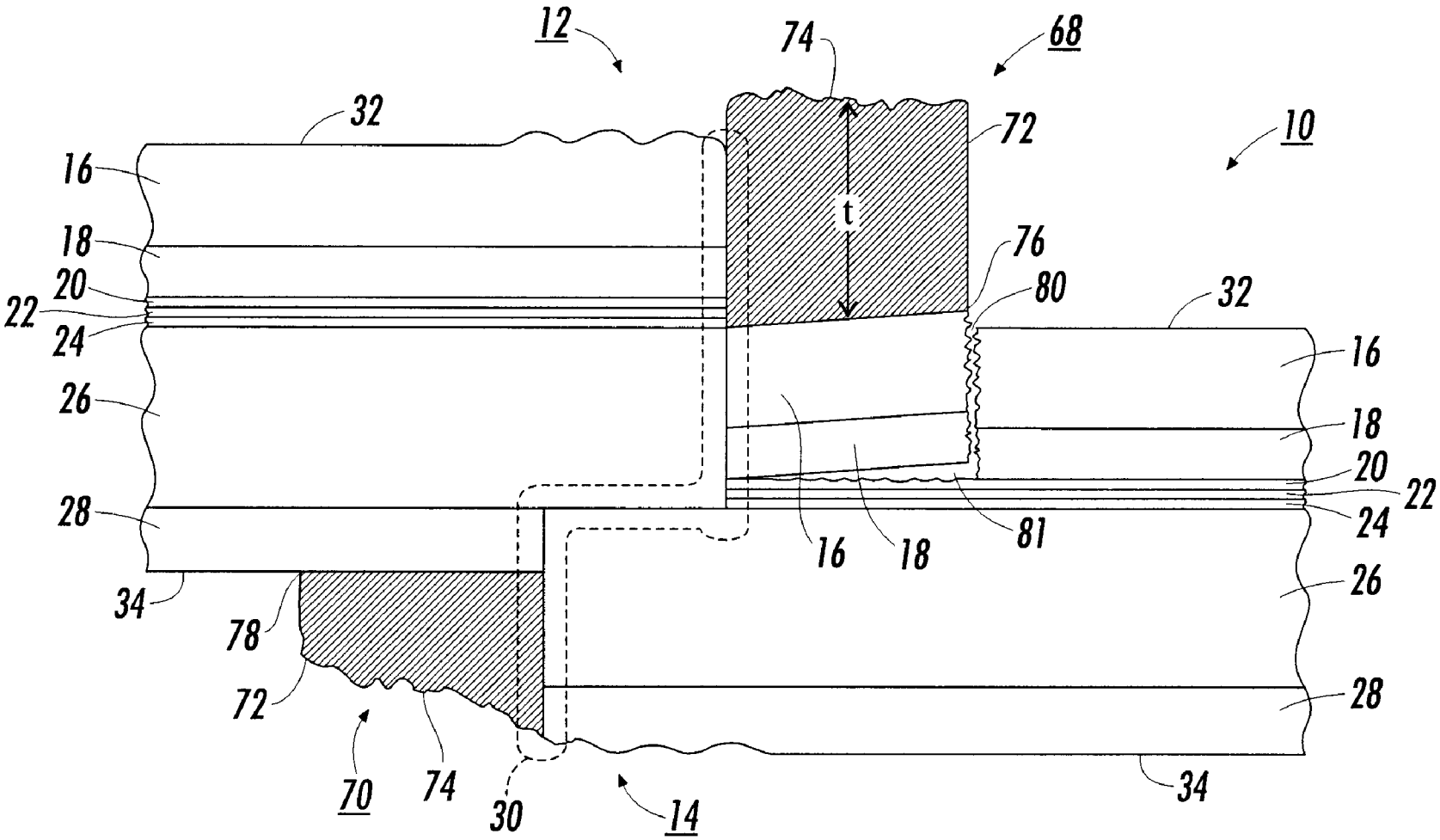
FIG. 3 illustrates a schematic partial cross-sectional view of a multiple layered seamed flexible electrophotographic imaging belt which has failed due to fatigue induced seam cracking and delamination.

Upon completion of welding of the overlap region of the imaging member sheet into a seam 30 using ultrasonic seam welding techniques, the overlap region is transformed into an overlapping and abutting region as illustrated in FIGS. 2 and 3. Within the overlapping and abutting region, the portions of the flexible member belt 10, which once formed the end marginal regions 12 and 14, are joined by the seam 30 such that the once end marginal regions 12 and 14 are overlapping and abutting one another. The welded seam 30 contains upper and lower splashings 68 and 70 at each end thereof as illustrated in FIGS. 2 and 4. The splashings 68 and 70 are formed in the process of joining the end marginal regions 12 and 14 together. Molten material is necessarily ejected from either side of the overlap region to facilitate direct support layer 26 of one end to support layer 26 of the other end fusing and results in the formation of the splashings 68 and 70. The upper splashing 68 is formed and positioned above the overlapping end marginal region 14 abutting the top surface 32 and adjacent to and abutting the overlapping end marginal region 12. The lower splashing 70 is formed and positioned below the overlapping end marginal region 12 abutting bottom surface 34 and adjacent to and abutting the overlapping end marginal region 14. The splashings 68 and 70 extend beyond the sides and the edges of the seam 30 in the overlap region of the welded flexible member 10. The extension of the splashings 68 and 70 beyond the sides and the edges of the seam 30 is undesirable for many machines such as electrophotographic copiers, duplicators and copiers that require precise edge positioning of a flexible member belt 10 during machine operation. Generally, the extension of the splashings 68 and 70 at the parallel belt edges of the flexible member belt 10 are removed by a notching operation.

A typical upper splashing 68 has a height or thickness t of about 90 micrometers and projects about 17 micrometers above the surface of the overlapping end marginal region 12. Each of the splashings 68 and 70 has an uneven but generally rectangular cross sectional shape including one side (free side) 72 (which forms a free end) extending inwardly toward top surface 32 from an outwardly facing side 74 (extending generally parallel to both the top surface 32 or the bottom surface 34). The free side 72 of the splashing 68 forms an approximately perpendicular angle $\theta_1$ at junction 76 with the bottom surface 34 of the flexible member belt 10. Likewise, the free side 72 of the splashing 70 forms an approximately perpendicular angle $\theta_2$ at the junction 78 of the free side 72 of the lower splashing 70 and the bottom surface 34 of the flexible member belt 10. Both junctions 76 and 78 provide focal points for stress concentration and become the initial points of failure affecting the mechanical integrity of the flexible member belt 10.

During machine operation, the seamed flexible imaging member belt 10 cycles or bends over rollers, particularly small diameter rollers, of a belt support module within an electrophotographic imaging apparatus. As a result of dynamic bending of the flexible imaging member belt 10 during cycling, the rollers repeatedly exert a force on the flexible imaging member belt 10 which causes large stresses to develop generally adjacent to the seam 30 due to the excessive thickness and material discontinuity thereof. The stress concentrations that are induced by bending near the junction points 76 and 78 may reach values much larger than the average value of the stress over the entire length of the flexible member belt 10. The induced bending stress is inversely related to the diameter of a roller over which the flexible imaging member belt 10 bends and directly related to the thickness of the seam 30 of the flexible imaging member belt 10. When a structural member, such as the flexible member 10, contains an abrupt increase in cross-sectional thickness at the overlap region, high localized stress occurs near this discontinuity, e.g., junction points 76 and 78.

When the flexible imaging member 10 bends over the exterior surfaces of rollers of a belt module within an electrophotographic imaging apparatus, the bottom surface 34 of the flexible imaging member belt 10 is compressed. In contrast, the top surface 32 is stretched under tension. This is attributable to the fact that the top surface 32 and bottom surface 34 move in a circular path about the circular roller. Since the top surface 32 is at greater radial distance from the center of the circular roller than the bottom surface 34, the top surface 32 must travel a greater distance than the bottom surface 34 in the same time period. Therefore, the top surface 32 must be stretched under tension relative to a generally central portion of the flexible imaging member belt 10 (the portion of the flexible imaging member belt 10 generally extending along the center of gravity of the flexible imaging member belt 10). Likewise, the bottom surface 34 must be compressed relative to the generally central portion of the flexible imaging member belt (the portion of the flexible imaging member belt 10 generally extending along the center of gravity of the flexible member 10). Consequently, the bending stress at the junction 76 will be tension stress, and the bending stress at the junction 78 will be compression stress.

Compression stresses, such as at the junction point 78, rarely cause seam 30 failure. Tension stresses, such as at junction point 76, however, are a more serious problem. The tension stress concentration at the junction 76 will eventually lead to crack initiation through the electrically active layers of the flexible imaging member belt 10 as illustrated in FIG. 3. Crack 80 is adjacent to the top splashing 68 of the second end marginal region 14 of the flexible imaging member belt 10. The generally vertically extending crack 80 initiated in the charge transport layer 16 continues to propagate through the generator layer 18. Inevitably, the crack 80 extends generally horizontally to develop seam delamination 81 which is propagated through the relatively weak adhesion bond between the adjoining surfaces of the generator layer 18 and the interface layer 20.

The formation of the local seam delamination 81 is typically referred to as seam puffing. The excess thickness of the splashing 68 and stress concentration at the junction 76 causes the flexible imaging member belt 10 to perform, during extended machine operation, as if a material defect existed therein. Thus, the splashing 68 tends to promote the development of dynamic fatigue failure of seam 30 and can lead to separation of the joined end marginal regions 12 and 14 leading to severing of the flexible member belt 10. Consequently, the service life of the flexible imaging member belt 10 is shortened.

In addition to seam failure, the crack 80 acts as a depository site and collects toner, paper fibers, dirt, debris and other unwanted materials during electrophotographic imaging and cleaning processes of the flexible imaging member belt 10. For example, during the cleaning process, a cleaning instrument, such as a cleaning blade, will repeatedly pass over the crack 80. As the site of the crack 80 becomes filled with debris, the cleaning instrument dislodges at least a portion of this highly concentrated level of debris from the crack 80. The amount of the debris, however, is beyond the removal capacity of the cleaning instrument. As a consequence, the cleaning instrument dislodges the highly concentrated level of debris but cannot remove the entire amount during the cleaning process. Instead, portions of the highly concentrated debris is deposited onto the surface of the flexible imaging member belt 10. In effect, the cleaning instrument spreads the debris across the surface of the flexible imaging member belt 10 instead of removing the debris therefrom.

In addition to seam failure and debris spreading, the portion of the flexible imaging member belt 10 above the seam delamination 81, in effect, becomes a flap which moves upwardly. The upward movement of the flap presents an additional problem during the cleaning operation. The flap becomes an obstacle in the path of the cleaning instrument as the instrument travels across the surface of the flexible imaging member belt 10. The cleaning instrument eventually strikes the flap when the flap extends upwardly. As the cleaning instrument strikes the flap, great force is exerted on the cleaning instrument which can lead to damage thereof, e.g., excessive wear and tearing of the cleaning blade.

Besides damaging the cleaning blade, the striking of the flap by the cleaning instrument causes unwanted vibration in the flexible imaging member belt 10. This unwanted vibration adversely affects the copy/print quality produced by the flexible imaging member belt 10. The copy/print is affected because imaging occurs on one part of the flexible imaging member belt 10 simultaneously with the cleaning of another part of the flexible imaging member belt 10.

In addition, the rough and hard surface topology of the seam splashing is found to wear the cleaning blade and nick the contacting edge of the blade during electrophotographic imaging and cleaning processes thereby reducing blade cleaning efficiency and shortening blade service life. However, with the incorporation of synthetic organic particles such as polytetrafluoroethylene particles dispersed in the anticurl backing layer according to the process of the present invention, the splashing surface is lubricated by the polytetrafluoroethylene particles to ease the sliding action of the blade on the seam splashing and suppress blade wear. Furthermore, improved dispersion of polytetrafluoroethylene particles in the anticurl backing layer also promotes improved flow of the ejected molten mass in a manner which produces a tapered splashing morphology without open pits and prevents early onset of fatigue seam cracking as well.

Any suitable synthetic solid organic particles may be utilized in the anticurl backing layer dispersions of this invention. Typical synthetic organic particles include, for example, polytetrafluoroethylene (PTFE) commercially available as POLYMIST, ALGOFLON and the like; micronized waxy polyethylene, e.g., commercially available as ACUMIST™; polyvinylidene fluoride, e.g., commercially available as KYNAR™; various metal stearates such as, for example, zinc stearate, and the like. Still other organic particles are disclosed in U.S. Pat. No. 5,021,309, the entire disclosure thereof being incorporated herein by reference. Preferably, the particle size distribution of these materials is from about 0.1 micrometer to about 7 micrometers. An optimum particle size distribution is between about 0.1 micrometer and about 4.5 micrometers with an average particle size of about 2.5 micrometers provides the best particle dispersion quality in the matrix of the anticurl backing layer. Typical organic particle dispersion concentrations in the outer exposed anticurl backing layer from about 0.1 weight percent to about 30 weight percent based on the total dried weight of the dried anticurl backing layer are found to yield effective wear resistance. These imaging member belts are then utilized for imaging in electrophotographic imaging systems. In one embodiment, a typical dried anticurl backing layer of the flexible electrophotographic imaging member belt fabricated by the process of this invention containing PTFE particles (Polymist, commercially available from Ausimont U.S,A., Inc.) dispersed in a film forming polymer matrix provides excellent mechanical results including improving wear resistance of the anticurl backing layer. Although a PTFE particle dispersion level from about 0.1 to about 30 percent by weight, based on the total dried weight of the resulting dried anticurl backing layer of the flexible electrophotographic imaging member belt gives satisfactory results, a particle dispersion of between about 2 percent and about 15 percent by weight yields optimum wear resistance.

When anticurl backing layer coating dispersions containing PTFE particles dispersed in a solution of film forming polymer dissolved in a solvent are applied to the back side of the substrate layer of flexible imaging member web to form an anticurl backing layer, the layer after drying can contain bubble defects. When fabricated into an imaging member belt and electrophotographically and cycled in an imaging machine, these bubble defects are found to prevent the anticurl backing layer from making intimate surface contact against the belt support module drive-roller causing undesirable imaging member belt slippage due to insufficient generation of frictional force to effectively drive the belt. This is manifested as copy print out defects in the final images. In the present invention, it has been shown that when a small amount of a specific fluorine-containing graft copolymer, based on methylmethacrylate (GF-300, available from Toagosai Chemical Industries), is added to the anticurl backing layer coating solution dispersion prior to the application of the coating solution onto the imaging member substrate, the final anticurl backing layer after coating and drying is free of bubble defects. This fluorinated additive contains repeating methylmethacrylate units in a molecular backbone, the repeating methylmethacrylate units containing a fluoro-alkyl pendant group. Further, this fluorinated additive contains different repeating methylmethacrylate units in the molecular backbone, the different repeating methylmethacrylate units containing a carbonyl and ester side chain. This fluorinated additive can be represented by the structural formula:

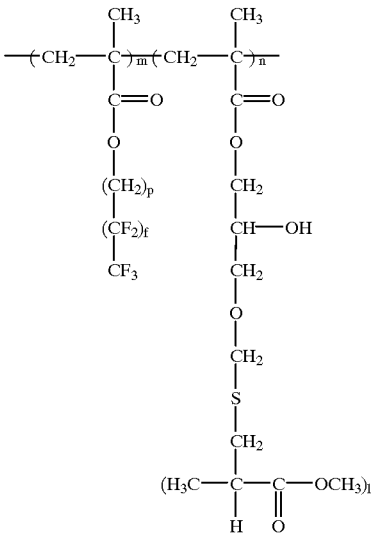

wherein m is a number from 1 to 99, n is a number from 1 to 99, p is an integer between 1 and 10, f is an integer between 1 and 8, and I is an integer between 10 and 500.

It is hypothesized that the synthetic organic particles, particularly irregularly shaped particles or particle agglomerates, carry trapped air into the dispersion and poor particle surface wetting by either the carrier liquid or the dissolved polymer molecules, lead to the formation of bubbles in the final dried anticurl backing layer. To prevent the formation of these bubbles in the final dried anticurl backing layer, it is believed that a first part of the fluorinated site in the additive molecule (namely the fluorinated part at the end of the pendant group) wets the outer surface of dispersed particles while a second part of the molecule (namely the ester group), being chemically compatible with the dissolved polymer, effects mixing with the polymer which thereby promoting particle dispersion and eliminating air entrapment to totally prevent the root cause of bubble formation in the final dried anticurl backing layer. The addition of the fluorinated additive molecule to the coating solution mixture at a level of from about 0.2 percent to about 5 percent by weight, based on the total weight of the dried anticurl backing layer coating dispersion satisfactorily eliminates bubbles in the final dried anticurl backing layer. Optimum results are achieved with fluorinated additive molecule levels between about 0.5 percent to about 3 percent by weight, based on the total weight of the dried anticurl backing layer coating containing the particle dispersion.

Any suitable film forming polymer may be utilized for the matrix of the anticurl layer of this invention. The film forming polymer should be soluble in the specific carrier liquid used. Typical film forming polymers include, for example, polycarbonate, polystyrene, ardel polyarylate, polyvinyl chloride, polyarcrylate, polyurethane, polyester, polysulfone, and the like. Preferably, the dried anticurl backing layer dispersion comprises from about 69.7 percent by weight to about 99.7 percent by weight of dissolved film forming polymer, based on the total dried weight of the layer.

Any suitable volatile carrier liquid may be utilized in the anticurl backing layer coating dispersion of this invention. Typical volatile carrier liquid include, for example, methylene chloride, toluene, chlorobenzene, THF, hexane, cyclohexane, heptane, and the like. Preferably, the anticurl backing layer coating dispersion comprises from about 75 percent by weight to about 95 percent by weight of volatile carrier liquid, based on the total weight of the coating dispersion. The specific volatile carrier liquid selected for the dispersion depends upon the specific film forming polymer, the selected additive, and synthetic organic particles used in the dispersion. The volatile carrier liquid should dissolve the film forming polymer and the selected organic additive, but not dissolve the synthetic organic particles.

Any suitable coating technique may be utilized to apply the anticurl backing layer coating solution dispersion to the substrate surface. Typical coating techniques include, for example, extrusion coating, spraying, dip coating, roll coating, wire wound rod coating, gravure coating, Bird applicator coating, and the like.

Any suitable technique may be utilize to dry the deposited anticurl backing layer dispersion coating. Typical coating techniques include, for example, oven drying, forced air drying, focussed infrared drying, RF drying, laser drying, microwave radiation, and the like. After drying, the dried anticurl backing layer is free of bubbles. Generally, the anticurl backing layer, after drying contains less than about 1.5 percent by weight carrier liquid, based on the total weight of the dried layer.

The dried anticurl backing layer should have a thickness sufficient to counteract the tendency of the flexible photoreceptor to curl after the imaging layers have been applied. In other words, the dried anticurl backing layer should cause an unrestrained flexible photoreceptor sheet to lie flat on a flat surface. Thus, the thickness of the dried anticurl backing layer will depend on the specific materials in and thicknesses of the other layers of any given photoreceptor. Preferably, the thickness of a dried anticurl backing layer is from about 10 micrometers to 25 micrometers. However, other thickness be used so long as the objectives of this invention are satisfied.

The flexible substrate to which the anticurl backing layer of this invention is applied may be opaque or substantially transparent and may comprise numerous suitable materials having the required mechanical properties. Accordingly, the substrate may comprise a layer of an electrically non-conductive or conductive material such as an inorganic or an organic composition. As electrically non-conducting materials, there may be employed various resins known for this purpose including polyesters, polycarbonates, polyamides, polyurethanes, polysulfones, and the like which are flexible as thin webs. The electrically insulating or conductive substrate should be flexible and in the form of a web, sheet or endless flexible belt. Preferably, the substrate comprises a commercially available biaxially oriented polyester known as Mylar, available from E. I. du Pont de Nemours & Co., or Melinex available from ICI Americas, Inc., or Hostaphan, available from American Hoechst Corporation.

The thickness of the substrate layer depends on numerous factors, including beam strength and economical considerations, and thus this layer for a flexible belt may be of substantial thickness, for example, about 175 micrometers, or of minimum thickness less than 50 micrometers, provided there are no adverse effects on the final electrostatographic device. In one flexible belt embodiment, the thickness of this layer ranges from about 65 micrometers to about 150 micrometers, and preferably from about 75 micrometers to about 100 micrometers for optimum flexibility and minimum stretch when cycled around small diameter rollers, e.g. 19 millimeter diameter rollers.

The conductive layer on the flexible substrate may vary in thickness over substantially wide ranges depending on the optical transparency and degree of flexibility desired for the electrostatographic member. Accordingly, for a flexible photoresponsive imaging device, the thickness of the conductive layer may be between about 20 angstrom units to about 750 angstrom units, and more preferably from about 100 Angstrom units to about 200 angstrom units for an optimum combination of electrical conductivity, flexibility and light transmission. The flexible conductive layer may be an electrically conductive metal layer formed, for example, on the substrate by any suitable coating technique, such as a vacuum depositing technique. Typical metals include aluminum, zirconium, niobium, tantalum, vanadium and hafnium, titanium, nickel, stainless steel, chromium, tungsten, molybdenum, and the like. Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as a transparent layer for light having a wavelength between about 4000 Angstroms and about 7000 Angstroms or a transparent copper iodide (CuI) or a conductive carbon black dispersed in a plastic binder as an opaque conductive layer.

An optional charge blocking layer may be applied to the electrically conductive surface prior to or subsequent to application of the anticurl backing layer to the opposite side of the substrate. Generally, electron blocking layers for positively charged photoreceptors allow holes from the imaging surface of the photoreceptor to migrate toward the conductive layer. Any suitable blocking layer capable of forming an electronic barrier to holes between the adjacent photoconductive layer and the underlying conductive layer may be utilized. The blocking layer may be nitrogen containing siloxanes or nitrogen containing titanium compounds as disclosed, for example, in U.S. Pat. No. 4,338,387, U.S. Pat. No. 4,286,033 and U.S. Pat. No. 4,291,110. The disclosures of these patents are incorporated herein in their entirety. A preferred blocking layer comprises a reaction product between a hydrolyzed silane and the oxidized surface of a metal ground plane layer. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like. The blocking layer should be continuous and have a thickness of less than about 0.2 micrometer because greater thickness may lead to undesirably high residual voltage.

An optional adhesive layer may applied to the hole blocking layer. Any suitable adhesive layer well known in the art may be utilized. Typical adhesive layer materials include, for example, polyesters, duPont 49,000 (available from E. I. duPont de Nemours and Company), Vitel PE100 (available from Goodyear Tire & Rubber), polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

Any suitable photogenerating layer may be applied to the adhesive blocking layer which can then be overcoated with a contiguous hole transport layer as described hereinafter. Examples of typical photogenerating layers include inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigment such as the X-form of metal free phthalocyanine described in U.S. Pat. No. 3,357,989, metal phthalocyanines such as vanadyl phthalocyanine and copper phthalocyanine, dibromoanthanthrone, squarylium, quinacridones available from DuPont under the tradename Monastral Red, Monastral violet and Monastral Red Y, Vat orange 1 and Vat orange 3 tradenames for dibromo anthanthrone pigments, benzimidazole perylene, substituted 2,4-diamino-triazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like dispersed in a film forming polymeric binder. Multi-photogenerating layer compositions may be utilized where a photoconductive layer enhances or reduces the properties of the photogenerating layer. Examples of this type of configuration are described in U.S. Pat. No. 4,415,639, the entire disclosure of this patent being incorporated herein by reference. Other suitable photogenerating materials known in the art may also be utilized, if desired. Charge generating binder layers comprising particles or layers comprising a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal free phthalocyanine and tellurium alloys are also preferred because these materials provide the additional benefit of being sensitive to infrared light.

Any suitable polymeric film forming binder material may be employed as the matrix in the photogenerating binder layer. Typical polymeric film forming materials include those described, for example, in U.S. Pat. No. 3,121,006, the entire.disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloridevinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts, generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition.

The photogenerating layer containing photoconductive compositions and/or pigments and the resinous binder material generally ranges in thickness of from about 0.1 micrometer to about 5 micrometers, and preferably has a thickness of from about 0.3 micrometer to about 3 micrometers. The photogenerating layer thickness is related to binder content. Higher binder content compositions generally require thicker layers for photogeneration. Thickness outside these ranges can be selected provided that the objectives of the present invention are achieved.

Any suitable and conventional technique may be utilized to mix and thereafter apply the photogenerating layer coating mixture. Typical application techniques include spraying, dip coating, roll coating, wire wound rod coating, and the like. Drying of the deposited coating may be effected by any suitable conventional technique such as oven drying, infra red radiation drying, air drying and the like.

The active charge transport layer may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer. An especially preferred transport layer employed in one of the two electrically operative layers in the multilayered photoconductor of this invention comprises from about 25 percent to about 75 percent by weight of at least one charge transporting aromatic amine compound, and about 75 percent to about 25 percent by weight of a polymeric film forming resin in which the aromatic amine is soluble.

The charge transport layer forming mixture preferably comprises an aromatic amine compound. Examples of charge transporting aromatic amines represented by the structural formulae above for charge transport layers capable of supporting the injection of photogenerated holes of a charge generating layer and transporting the holes through the charge transport layer include triphenylmethane, bis(4-diethylamine-2-methylphenyl) phenylmethane; 4-'–4"-bis (diethylamino)-2',2"-dimethyltriphenylmethane, N,N'-bis (alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3"-methylphenyl)-(1,1"-biphenyl)-4,4"-diamine, and the like dispersed in an inactive resin binder.

Any suitable inactive thermoplastic resin binder soluble in methylene chloride or other suitable solvent may be employed in the process of this invention to form the thermoplastic polymer matrix of the imaging member. Typical inactive resin binders soluble in methylene chloride include polycarbonate resin, polyvinylcarbazole, polyester, polyarylate, polyacrylate, polyether, polysulfone, polystyrene, polyamide, and the like. Molecular weights can vary from about 20,000 to about 150,000.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like.

Generally, the thickness of the charge transport layer is between about 10 to about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layer is preferably maintained from about 2:1 to 200:1 and in some instances as great as 400:1.

The preferred electrically inactive resin materials are polycarbonate resins have a molecular weight from about 20,000 to about 150,000, more preferably from about 50,000 to about 120,000. The materials most preferred as the electrically inactive resin material is poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from the General Electric Company; a polycarbonate resin having a molecular weight of from about 50,000 to about 120,000, available as Makrolon from Farbenfabricken Bayer A. G. and a polycarbonate resin having a molecular weight of from about 20,000 to about 50,000 available as Merlon from Mobay Chemical Company. Methylene chloride solvent is a desirable component of the charge transport layer coating mixture for adequate dissolving of all the components and for its low boiling point.

Examples of photosensitive members having at least two electrically operative layers include the charge generator layer and diamine containing transport layer members disclosed in U.S. Pat. No. 4,265,990, U.S. Pat. No. 4,233,384, U.S. Pat. No. 4,306,008, U.S. Pat. No. 4,299,897 and U.S. Pat. No. 4,439,507. The disclosures of these patents are incorporated herein in their entirety. The photoreceptors may comprise, for example, a charge generator layer sandwiched between a conductive surface and a charge transport layer as described above or a charge transport layer sandwiched between a conductive surface and a charge generator layer.

If desired, a charge transport layer may comprise electrically active resin materials instead of or mixtures of inactive resin materials with activating compounds. Electrically active resin materials are well known in the art. Typical electrically active resin materials include, for example, polymeric arylamine compounds and related polymers described in U.S. Pat. No. 4,801,517, U.S. Pat. No. 4,806,444, U.S. Pat. No. 4,818,650, U.S. Pat. No. 4,806,443 and U.S. Pat. No. 5,030,532. Polyvinylcarbazole and derivatives of Lewis acids described in U.S. Pat. No. 4,302,521. Electrically active polymers also include polysilylenes such as poly(methylphenyl silylene), poly(methylphenyl silylene-co-dimethyl silylene), poly(cyclohexylmethyl silylene), poly(tertiarybutylmethyl silylene), poly(phenylethyl silylene), poly(n-propylmethyl silylene), poly(p-tolylmethyl silylene), poly(cyclotrimethylene silylene), poly (cyclotetramethylene silylene), poly(cyclopentamethylene silylene), poly(di-t-butyl silylene-co-di-methyl silylene), poly(diphenyl silylene-co-phenylmethyl silylene), poly (cyanoethylmethyl silylene) and the like. Vinylaromatic polymers such as polyvinyl anthracene, polyacenaphthylene; formaldehyde condensation products with various aromatics such as condensates of formaldehyde and 3-bromopyrene; 2,4,7-trinitrofluoreoene, and 3,6-dinitro-N-t-butylnaphthalimide as described in U.S. Pat. No. 3,972,717. Other polymeric transport materials include poly-1-vinylpyrene, poly-9-vinylanthracene, poly-9-(4-pentenyl)-carbazole, poly-9-(5-hexyl)-carbazole, polymethylene pyrene, poly-1-(pyrenyl)-butadiene, polymers such as alkyl, nitro, amino, halogen, and hydroxy substitute polymers such as poly-3-amino carbazole, 1,3-dibromo-poly-N-vinyl carbazole and 3,6-dibromo-poly-N-vinyl carbazole and numerous other transparent organic polymeric transport materials as described in U.S. Pat. No. 3,870,516. The disclosures of each of the patents identified above pertaining to binders having charge transport capabilities are incorporated herein by reference in their entirety.

Other layers such as conventional electrically conductive ground strip along one edge of the belt in contact with the conductive layer, blocking layer, adhesive layer or charge generating layer to facilitate connection of the electrically conductive layer of the photoreceptor to ground or to an electrical bias. Ground strips are well known and comprise usually comprise conductive particles dispersed in a film forming binder.

An overcoat layer may also be utilized to protect the charge transport layer and improve resistance to abrasion. These overcoat layers are well known in the art and may comprise thermoplastic organic polymers or inorganic polymers that are electrically insulating or slightly semi-conductive.

For electrographic imaging members, a flexible dielectric layer overlying the conductive layer may be substituted for the active photoconductive layers. Any suitable, conventional, flexible, electrically insulating, thermoplastic dielectric polymer matrix material may be used in the dielectric layer of the electrographic imaging member. If desired, the flexible belts of this invention may be used for other purposes where cycling durability is important.

The advantageous effects achieved with the enhanced anticurl backing layer fabrication process described above are achieved by using the dispersed synthetic organic particles with a specific fluorinated additive. Surprisingly, this fabrication process does not produce any noticeable negative electrical impact on the final electrophotographic imaging member belt. Thus, the process of this invention eliminates the formation of bubbles in the dried anticurl backing layer. Elimination of the bubbles improves thickness uniformity of the layer, reduces wear rate, and prevents premature cracking of the imaging member when cycled around small diameter support rollers during image cycling. Further, elimination of the bubbles improves rear erase of a photoreceptor by achieving more uniform discharge. Also, open pits in the seam splashing are avoided thereby reducing undesirable dirt and increasing cleaning blade life.

The invention will further be illustrated in the following non-limiting examples, it being understood that these examples are intended to be illustrative only and that the invention is not intended to be limited to the materials, conditions, process parameters and the like recited herein. All proportions are by weight unless otherwise indicated.

CONTROL EXAMPLE I

A flexible electrophotographic imaging member web stock was prepared by providing a 0.02 micrometer thick titanium layer coated on a flexible polyester substrate (Melinex 442, available from ICI Americas, Inc.) having a thickness of 3 mils (76.2 micrometers) and applying thereto, by a gravure coating process, a solution containing 10 grams gamma aminopropyltriethoxy silane, 10.1 grams distilled water, 3 grams acetic acid, 684.8 grams of 200 proof denatured alcohol and 200 grams heptane. This layer was then dried at 135° C. in a forced air oven. The resulting blocking layer had an average dry thickness of 0.05 micrometer measured with an ellipsometer.

An adhesive interface layer was then extrusion coated by applying to the blocking layer a wet coating containing 5 percent by weight based on the total weight of the solution of polyester adhesive (Mor-Ester 49,000, available from Morton Intemational, Inc.) in a 70.30 volume ratio mixture of tetrahydrofuran/cyclohexanone. The resulting adhesive interface layer, after passing through an oven, had a dry thickness of 0.065 micrometer.

The adhesive interface layer was thereafter coated, by extrusion, with a photogenerating layer containing 7.5 percent by volume trigonal Se, 25 percent by volume N,N'-diphenyl-N,N'-bis(3-methylphenyl)-1,1'-biphenyl-4,4'-diamine, and 67.5 percent by volume polyvinylcarbazole. This photogenerating layer was prepared by introducing 8 grams polyvinyl carbazole and 140 mls of a 1:1 volume ratio of a mixture of tetrahydrofuran and toluene into a 20 oz. amber bottle. To this solution was added 8 grams of trigonal selenium and 1,000 grams of ⅛ inch (3.2 millimeter) diameter stainless steel shot. This mixture was then placed on a ball mill for 72 to 96 hours. Subsequently, 50 grams of polyvinyl carbazole and 2.0 grams of N,N'-diphenyl-N,N'-bis (3-methylphenyl)-1,1'-biphenyl-4,4'-diamine dissolved in 75 ml of 1:1 volume ratio of tetrahydrofuran/toluene. This slurry was then placed on a shaker for 10 minutes. The resulting slurry was thereafter extrusion coated onto the adhesive interface layer to form a coating layer having a wet thickness of 0.5 mil (12.7 micrometers). However, a strip about 10 mm wide along one edge of the substrate bearing the blocking layer and the adhesive layer was deliberately left uncoated by any of the photogenerating layer material to facilitate adequate electrical contact by a ground strip layer that was applied later. This photogenerating layer was dried at 135° C. to form a dry photogenerating layer having a thickness of 2.0 micrometers.

This coated imaging member web was simultaneously extrusion overcoated with a charge transport layer (CTL) and a ground strip layer using a 3 mil gap Bird applicator. The charge transport layer was prepared by introducing into an amber glass bottle a weight ratio of 1:1 N,N'-diphenyl-N,N'-bis(3-methylphenyl)-1,1'-biphenyl-4,4'-diamine and Makrolon 5705, a polycarbonate resin having a molecular weight of from about 50,000 to 100,000 commercially available from Farbensabricken Bayer A.G. The resulting mixture was dissolved to give a 15 percent by weight solids in 85 percent by weight methylene chloride. This solution was applied onto the photogenerator layer to form a coating which, upon drying, had a thickness of 24 micrometers.

The approximately 10 mm wide strip of the adhesive layer left uncoated by the photogenerator layer was coated with a ground strip layer during a co-coating process. This ground strip layer, after drying at 135° C. in an oven, had a dried thickness of about 14 micrometers. This ground strip was electrically grounded, by conventional means such as a carbon brush contact means during conventional xerographic imaging process. The electrophotographic imaging member web stock, at this point if unrestrained, would spontaneously curl upwardly into 1 ½ inch diameter tube. Therefore, the application of an anticurl backing layer was required to provide the desired imaging member web flatness.

An anticurl backing layer coating solution was prepared by combining 8.82 grams of polycarbonate resin (Makrolon 5705, available from Bayer AG), 0.72 gram of polyester resin (Vitel PE-200, available from Goodyear Tire and Rubber Company) and 90.1 grams of methylene chloride in a glass container to form a coating solution containing 8.9 percent by weight solids. The container was covered tightly and placed on a roll mill for about 24 hours until the polycarbonate and polyester were dissolved in the methylene chloride to form the anticurl coating solution. The anticurl backing layer coating solution was then applied to the rear surface of the substrate (the side opposite the photogenerator layer and charge transport layer) of the imaging member and dried at 135° C. to produce a dried anticurl backing layer (ACBC) thickness of about 13.5 micrometers. The resulting electrophotographic imaging member web stock had the desired flatness and with a structure similar to that schematically shown in FIG. 2. The fabricated electrophotographic imaging member web stock was used to serve as an imaging member control.

COMPARATIVE EXAMPLE II

A flexible electrophotographic imaging member web stock was prepared by following the procedures and using materials as described in the Control Example I except that the anticurl coating solution contained a 10 percent by weight Polymist dispersion [polytetrafluoroethylene, (PTFE) particles, available from Ausimomt USA, Inc.] with respect to the total solids content. After drying, the resulting dried anticurl backing layer coated to the backside of the substrate of the imaging member web stock had fine bubbles present in the matrix of the layer. These bubbles were unacceptable for high quality imaging member belts, because sufficient intimate surface contact between the anticurl backing layer and the drive-roller of a belt support roller could not be established to generate adequate frictional force to effectively drive the belt and provide uniform belt motion quality. Thus, belt slippage occurred during electrophotographic imaging machine operation. The imaging member belt slippage problem is found to lead to print out defects in the final copies. Moreover, the bubbles present in the anticurl backing layer can also cause light scattering effects which change the optical clarity of the anticurl backing layer thereby adversely affecting the effectiveness of imaging member belt back illumination erase

EXAMPLE III

A flexible electrophotographic imaging member web stock was prepared according to Comparative Example II, except that a 2 percent by weight, with respect to the total solid content, of a fluorinated additive (GF-300, a fluorine containing graft copolymer based on methylmethacrylate, available from Toagosei Chemical Industries) was added to the anticurl coating solution prior to coating. The resulting imaging member web stock after drying had an anticurl backing layer free of bubble defects in the material matrix of the dried layer.

EXAMPLE IV

A flexible electrophotographic imaging member web stock was prepared according to Example III, except that the anticurl backing layer contained 20 percent by weight Polymist dispersion, with respect to the total solids content. The dried anticurl backing layer had no bubble defects.

EXAMPLE VI

The electrophotographic imaging members of Control Example I, Example III, and Example IV were evaluated for interfacial contact friction between the charge transport layer and the anticurl backing layer to assess surface frictional interaction between these two contacting layers in a 6,000 foot wound up roll of imaging member web stock. More specifically, the effect of the dispersed Polymist in the anticurl backing layer on reduction of surface contact friction against the charge transport layer was determined. The coefficient of friction test was carried out by fastening a sample of an imaging member from each Example to a flat platform surface with the charge transport layer facing upwardly. Another sample of an imaging member from each same Example was secured to the flat surface of the bottom of a horizontally sliding plate weighing 200 grams, the anticurl backing layer of the sample facing outwardly away from the sliding plate. The sliding plate was then dragged, with the anticurl backing layer facing downwardly, in a straight line over the platform so that the horizontal anticurl backing layer surface moved while in frictional engagement with the horizontal charge transport layer surface. The sliding plate was moved by a cable having one end attached to the plate and having the other end threaded around a freely rotatable pulley and fastened to the jaw of an Instron Tensile Tester. The pulley was positioned so that the segment of the cable between the weight and the pulley was parallel to the flat horizontal platform surface. The cable was pulled vertically upward from the pulley by the jaw of the Instron Tensile Tester and the load required to slide the sliding plate, with the anticurl backing layer surface against the charge transport layer surface, was monitored using a chart recorder. The coefficient of friction between the charge transport layer and the anticurl backing layer was then calculated by dividing the sliding force or load recorded by the chart recorder by 200 grams.

The results obtained for coefficient of surface contact friction of the charge transport layer (CTL) against the anticurl backing layer (ACBC) are tabulated in the table below:

TABLE

| Sample | Polymist in ACBC (wt %) | Coeff. of Friction CTL/ACBC |
|---|---|---|
| I (Control) | 0 | 3.22 |
| III | 10 | 0.55 |
| IV | 20 | 0.53 |

The data shown in the table indicate that dispersion of Polymist in the imaging member anticurl backing layer matrix, at a concentration of 10 percent and 20 percent by weight can effectively reduce the charge transport layer anticurl backing layer surface contact friction. This result thereby eased the sliding action at the contacting surface in a wound up imaging member web stock and eliminated dimples, creases, and puckering physical defects in the imaging member coating layer which are often observed in the rejected segments of a roll-up imaging member web stock of Control Example I.

The electrophotographic imaging members of Examples I, II, and II were cut to a size of 1 inch (2.54 cm.) by 12 inches (30.48 cm.) and tested for resistance to wear. Testing was effected by means of a dynamic mechanical cycling device in which glass tubes were skidded across the surface of the charge transport layer on each imaging member. More specifically, one end of the test sample was clamped to a stationary post and the sample was looped upwardly over three equally spaced horizontal glass tubes and then downwardly over a stationary guide tube through a generally inverted U shaped path with the free end of the sample secured to a weight which provided one pound per inch (0.17 kilogram per cm) width tension on the sample. The outer surface of the imaging member bearing the anticurl backing layer faced downwardly so that it would periodically be brought into sliding mechanical contact with the glass tubes. The glass tubes had a diameter of one inch (2.54 cm).

Each tube was secured at each end to an adjacent vertical surface of a pair of disks that were rotatable about a shaft connecting the centers of the disks. The glass tubes were parallel to and equidistant from each other and equidistant from the shaft connecting the centers of the disks. Although the disks were rotated about the shaft, each glass tube was rigidly secured to the disk to prevent rotation of the tubes around each individual tube axis. Thus, as the disk rotated about the shaft, two glass tubes were maintained at all times in sliding contact with the outer surface of the charge transport layer. The axis of each glass tube was positioned about 4 cm from the shaft. The direction of movement of the glass tubes along the anticurl backing layer surface was away from the weighted end of the sample toward the end clamped to the stationary post. Since there were three glass tubes in the test device, each complete rotation of the disk was equivalent to three wear cycles in which the surface of the anticurl backing layer was in sliding mechanical contact with a single stationary support tube during the testing. The rotation of the spinning disk was adjusted to provide the equivalent of 11.3 inches (28.7 cm.) per second tangential speed. The extent of anticurl backing layer wear was measured using a permascope at the end of a 330,000 wear cycles test. The wear testing results obtained clearly established that the Polymist dispersion gave superior anticurl backing layer wear. At a 10 percent by weight Polymist loading, the wear resistance of the anticurl backing layer of the imaging member of Example III was more than 500 times above that of the anticurl backing layer of Control Example I and no measurable anticurl backing layer wear was noted as the Polymist dispersion level was increased to 20 percent by weight. The dispersion of Polymist with fluorinated additive in the anticurl backing layer also produced the added benefit of providing an increase in adhesion bond strength between the anticurl backing layer and the polyester substrate as well as eliminating the bubble formation problem.

EXAMPLE VI

The flexible electrophotographic imaging member web stocks of Control Example I, Comparative Example II, and Example III were each cut to precise dimensions of 440 mm width and 2,808 mm in length. Each cut imaging member sheet was ultrasonically welded in the long dimension to form a seamed flexible imaging member belt for fatigue dynamic electrophotographic imaging test in a xerographic machine.

The test results obtained showed that the control imaging member belt of Control Example I quickly developed a fatigue induced belt ripple problem; the onset of 50 micrometer belt ripples was noticed after only about 60 belt cycles. The belt ripple magnitude was observed to grow with belt cycling time and reached a magnitude of about 500 micrometers after 10,000 belt cycles. The induced belt ripples at a magnitude of over 100 micrometers were all manifested as copy print out defects. In contrast, the onset of 50 micrometers dynamic fatigue induced imaging belt ripples, for both belts of Comparative Example II and Example II, after 60 imaging member belt cycles were suppressed with belt cycling time. Further, the magnitude of the ripples was observed to decrease to only about 25 micrometers till the end of 150,000 belt cycles. It should be noted that belt ripples having a magnitude below 50 micrometers have never been found to print out as a copy defect.

Although belt cycling tests showed Polymist dispersion in the anticurl backing layer was effective in suppressing ripples development, nevertheless the belt of Comparative Example II having bubbles in the anticurl backing layer, was observed to frequently encounter belt slippage problems as reflected in poor belt cyclic motion quality. This is because surface contact between the anticurl backing layer and the drive-roller was insufficient to generate a constant frictional driving belt force. By comparison, the imaging member belt having the bubble free anticurl backing layer prepared according to the process of the present invention of Example III, did not exhibit any belt motion quality problems throughout the entire test.

It was also noted that the ultrasonically welded seam of the imaging member belt of Example III had a tapered top seam splashing and onset of seam cracking/delamination problems developed only after cycling of the belt was extended about 20 percent more than the number cycles when cracking/delamination problems developed in the imaging member belt of Control Example I.

Although the invention has been described with reference to specific preferred embodiments, it is not intended to be limited thereto, rather those having ordinary skill in the art will recognize that variations and modifications may be made therein which are within the spirit of the invention and within the scope of the claims.

What is claimed is:

1. A process comprising providing at least a flexible substrate layer having a first major surface on one side and a second major surface on a second side opposite the first major surface, the first major surface being an exposed surface, applying a coating of an anticurl backing layer dispersion on the first major surface of the substrate layer, the dispersion comprising a volatile carrier liquid, a film forming polymer dissolved in the volatile carrier liquid, solid organic particles dispersed in the volatile carrier liquid, and an organic additive dissolved in the volatile carrier liquid, the organic additive represented by the structural formula:

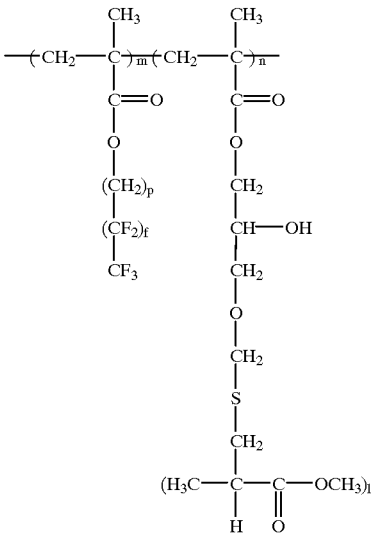

wherein m is a number from 1 to 99, n is a number from 1 to 99, p is an integer between 1 and 10, f is an integer between 1 and 8, and I is an integer between 10 and 500, and drying the coating to remove the volatile carrier liquid and form a dried anticurl backing layer.

2. A process according to claim 1 wherein the dried anticurl backing layer comprises from about 0.2 percent to about 5 percent by weight of the fluorinated additive, based on the total weight of the anticurl backing layer.

3. A process according to claim 1 wherein the dried anticurl backing layer comprises from about 0.5 percent to about 3 percent by weight of the fluorinated additive, based on the total weight of the anticurl backing layer.

4. A process according to claim 1 wherein the dried anticurl backing layer comprises from about 0.1 weight percent to about 30 weight percent of synthetic organic particles, based on the total weight of the anticurl backing layer.

5. A process according to claim 4 wherein the dried anticurl backing layer comprises from about 2 weight percent to about 15 weight percent synthetic organic particles, based on the total dried weight of the dried anticurl backing layer.

6. A process according to claim 1 wherein the synthetic organic particles have a particle size distribution of from about 0.1 micrometer to about 4.5 micrometers.

7. A process according to claim 1 wherein the synthetic organic particles comprise polytetrafluoroethylene particles.

8. A process according to claim 1 wherein the dried anticurl backing layer is substantially free of bubbles.

9. An electrostatographic imaging member comprising a flexible substrate layer having a first major surface on one side and a second major surface on a second side opposite the first major surface, and an anticurl backing layer on the first major surface of the substrate layer, the anticurl backing layer comprising solid organic particles dispersed in a solid matrix comprising a film forming polymer and a fluorinated additive represented by the structural formula:

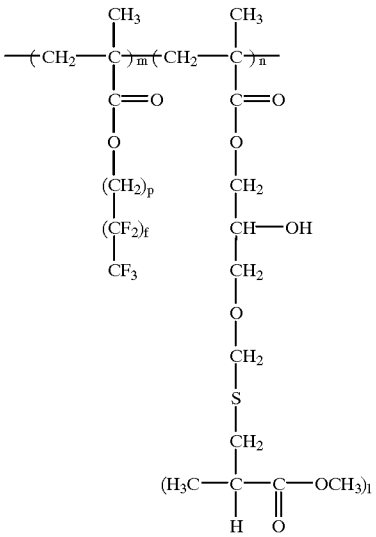

wherein m is a number from 1 to 99, n is a number from 1 to 99, p is an integer between 1 and 10, f is an integer between 1 and 8, and I is an integer between 10 and 500.

10. An electrostatographic imaging member according to claim 9 wherein the anticurl backing layer comprises from about 0.2 percent to about 5 percent by weight of the fluorinated additive, based on the total weight of the anticurl backing layer.

11. An electrostatographic imaging member according to claim 9 wherein the anticurl backing layer comprises from about 0.5 percent to about 3 percent by weight of the fluorinated additive, based on the total weight of the anticurl backing layer.

12. An electrostatographic imaging member according to claim 9 wherein the anticurl backing layer comprises from about 0.1 weight percent to about 30 weight percent of synthetic organic particles, based on the total weight of the anticurl backing layer coating.

13. An electrostatographic imaging member according to claim 12 wherein the anticurl backing layer comprises from about 2 weight percent to about 15 weight percent synthetic organic particles, based on the total dried weight of the dried anticurl backing layer.

14. An electrostatographic imaging member according to claim 9 wherein the synthetic organic particles have a particle size distribution of from about 0.1 micrometer to about 4.5 micrometers.

15. An electrostatographic imaging member according to claim 9 wherein the synthetic organic particles comprise polytetrafluoroethylene particles.

16. An electrostatographic imaging member according to claim 9 wherein the anticurl backing layer is substantially free of bubbles.

17. An electrostatographic imaging member according to claim 9 wherein the second major surface of the flexible substrate layer has a charge generating layer and a charge transport layer.

18. An electrostatographic imaging member according to claim 9 wherein the second major surface of the flexible substrate layer has a dielectric imaging layer.

* * * * *